US008408539B2

(12) United States Patent
Moore

(10) Patent No.: US 8,408,539 B2
(45) Date of Patent: Apr. 2, 2013

(54) SHEET TRANSPORT AND HOLD DOWN APPARATUS

(75) Inventor: Steven R. Moore, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/164,412

(22) Filed: Jun. 20, 2011

(65) Prior Publication Data

US 2012/0319347 A1 Dec. 20, 2012

(51) Int. Cl.
*B65H 29/30* (2006.01)

(52) U.S. Cl. ..... 271/193; 271/194; 271/196; 271/197; 271/276

(58) Field of Classification Search ..... 271/193, 271/194, 196, 197, 276
See application file for complete search history.

(56) References Cited

U.S. PATENT DOCUMENTS 4,244,465 A * 1/1981 Hishikawa et al. ..... 198/691
7,731,186 B2 6/2010 Krause et al.
8,025,394 B2 * 9/2011 Nishizaki et al. ..... 347/107
8,066,282 B2 * 11/2011 Muller et al. ..... 271/276
8,157,369 B2 * 4/2012 Hoover et al. ..... 347/104
2009/0154976 A1 6/2009 Castillo et al.
2010/0245448 A1 * 9/2010 Kato et al. ..... 347/16
2011/0128339 A1 * 6/2011 Kato ..... 347/104
2011/0292145 A1 * 12/2011 Hoover et al. ..... 347/104

* cited by examiner

*Primary Examiner* — Luis A Gonzalez
(74) *Attorney, Agent, or Firm* — Hoffmann & Baron, LLP

(57) ABSTRACT

A media sheet transport including a belt for supporting the media thereon. The belt is operably connected to a drive mechanism for moving the belt in a process direction past an image marking unit. The belt has a plurality of openings therein. A vacuum plenum has a surface disposed below the belt and is operably connected to a vacuum source. The vacuum plenum is adapted to applying a negative pressure to the media for holding the media to the belt. An electrostatic hold down apparatus includes a first tacking roller spaced in a cross-process direction from a second tacking roller. The first and second tacking rollers are engagable with the belt. The first tacking roller is disposed to engage the inboard edge of the media, and the second tacking roller is disposed to engage the outboard edge of the media. The first and second tacking rollers impart an electrostatic charge to the edges of the media for electrostatically securing the inboard and outboard edges of the media to the belt.

15 Claims, 4 Drawing Sheets

SHEET TRANSPORT AND HOLD DOWN APPARATUS

TECHNICAL FIELD

The presently disclosed embodiments are directed to an apparatus for holding down sheets in a media transport system.

BACKGROUND

In current direct printing processes, such as ink jet direct printing, an important print process parameter is the print head to media gap. To accomplish direct-to-paper printing, the paper media has to be carefully and accurately registered, and held down so that it does not come in contact with the print heads. Media gaps may be on the order of 0.5 mm in order to minimize the pixel placement errors due to misdirected jets. Such tight print head to media gaps pose a serious challenge for any cut sheet printer, since the sheet lead edge (LE) and trail edge (TE), and to a lesser extent the sheet body, do not lie perfectly flat. Small departures (<0.1 mm) in local flatness may induce a pixel placement error that may cause an image quality defect. Larger departures (>0.5 mm) in local flatness can cause contact between media and the print head front face. This is undesirable since media particles could be forced into nozzles and any anti-wetting coating on the front face may be damaged. For accurate pixel placement and color registration, it is desirable to keep the print head to media gap within a +/−0.1 mm range about the nominal. However, in order to avoid print head front face damage, the media should not be permitted to close the gap and contact the print head.

Currently known paper hold-down technologies include; "mechanical grippers", "electrostatics", "vacuum" and combinations of these systems and devices. Gripper systems can reliably hold sheet edges down, however these are complex, expensive devices and issues exist if different length media are to be transported. Vacuum sheet transport belts may be used to hold down sheets. However, such transports require a relatively high level of vacuum in order to hold the sheet of media flat, and generating and supplying this level of vacuum adds a significant expense. High levels of vacuum also pull the belt and sheet onto a plate below the belt thereby creating a significant amount of drag on the belt. This slows the belt and increases the wear on tear on the system.

A vacuum system may be supplemented with a sheet precurling subsystem which biases the sheets into a downcurl mode, i.e., the LE and TE are curved downwardly. This approach offers little hold down latitude for a sheet having any local upcurl at a corner or side edge. In addition, vacuum systems tend to have leakage at the edges; and therefore, the edges may not be held down in a satisfactory manner. An improvement is to provide higher vacuum pressure along sheet edges, such as the inboard and outboard sheet edges, in order to provide increased hold down force locally along the edges. However, considerable complexity and cost must be added to adapt the vacuum belt transport systems having such locally higher pressures so that they can accommodate media having varying widths.

As an alternative to vacuum hold down systems, electrostatic systems have been employed to hold down media as it passes past a print head. However, the use of an electrostatic charge to hold down sheets has heretofore had limited applications Inks used in many printing processes are capable of being electrically charged. Accordingly, if the electrostatic hold down charge were to cover the printing zone of the sheet, a net electrical charge may be induced in the ink droplets, and the droplets can be deflected by the electric field within the printing zone. Such interaction between the ink and the hold down charge can seriously degrade the quality of the printed image. Accordingly, printing systems using electrostatic hold down are limited to use very low conductivity inks or to apply low net tacking charge on the media, resulting in low sheet tack pressure.

Accordingly, it would be desirable to provide a sheet transport apparatus which is capable of holding sheets in a flat orientation without adding undue cost and complexity.

SUMMARY

There is provided a media sheet transport including a belt for supporting the media thereon. The belt is operably connected to a drive mechanism for moving the belt in a process direction past an image marking unit. The belt has a plurality of openings therein. A vacuum plenum has a surface disposed below the belt and is operably connected to a vacuum source. The vacuum plenum is adapted to applying a negative pressure to the media for holding the media to the belt. An electrostatic hold down apparatus includes a first tacking roller spaced in a cross-process direction from a second tacking roller. The first and second tacking rollers are engagable with the belt. The first tacking roller is disposed to engage the inboard edge of the media, and the second tacking roller is disposed to engage the outboard edge of the media. The first and second tacking rollers impart an electrostatic charge to the edges of the media for electrostatically securing the inboard and outboard edges of the media to the belt.

There is also provided an apparatus for holding down a media sheet in a media transport including a vacuum plate having a plurality of apertures in communication with a vacuum source. A substantially nonconductive belt is translatable in a process direction over the vacuum plate. The belt includes a plurality of holes therein, and an upper surface of the belt is adapted to support a media sheet. The vacuum plate is adapted to hold the media sheet to the belt. First and second tacking devices are supported in contact with the belt. The first and second tacking devices are spaced from each other in a cross-process direction, and are operably coupled to an electrical power source. The first and second tacking devices are adapted to impart an electrostatic charge to inboard and outboard edges of the media sheet for electrostatically securing the inboard and outboard edges to the belt.

There is further provided a method for securing a sheet of media for transport past a marking device including:

holding the sheet down on a moving belt by applying a vacuum to the sheet;

positioning a first tacking device to substantially align with the inboard edge of the sheet;

positioning a second tacking device to substantially align with the outboard edge of the sheet;

applying an electric potential to the first and second tacking rollers;

transporting the sheet with the belt past the first and second tacking devices; and depositing an electrostatic charge to the sheet inboard and outboard edges with the first and second tacking devices to electrostatically secure the sheet inboard and outboard edges to the belt.

DETAILED DESCRIPTION

Figure 1:
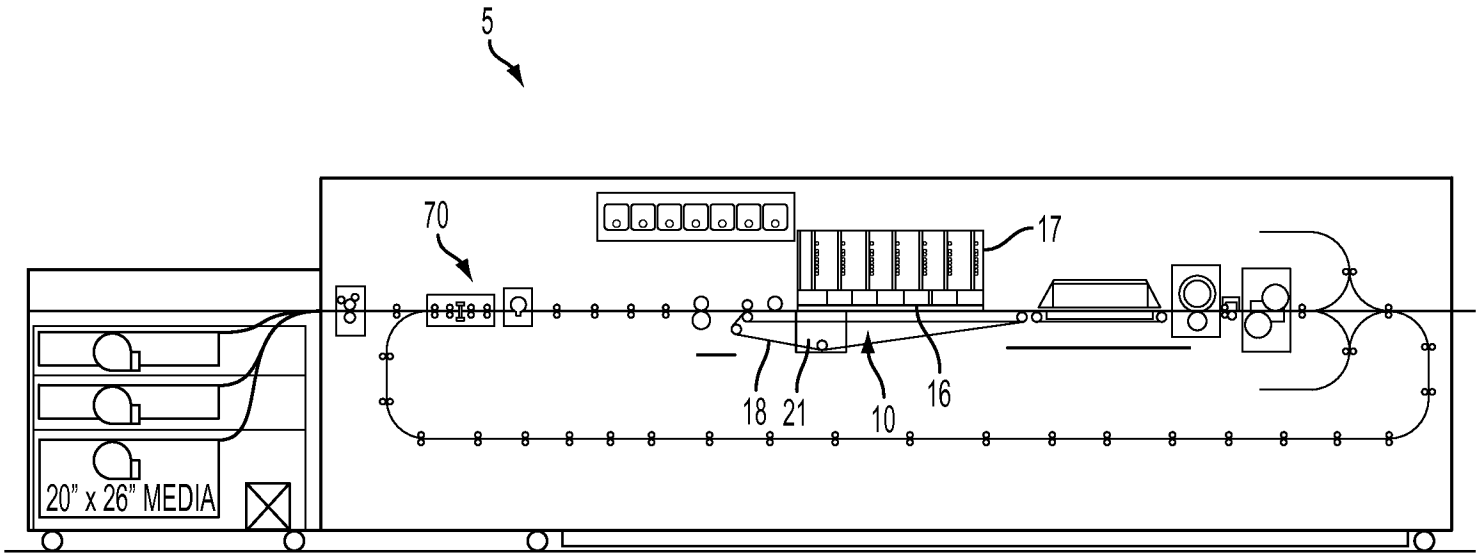
FIG. 1 is a schematic elevational view of an exemplary printing system including an apparatus of the present disclosure.

The present disclosure relates to media sheet transport having a media hold down apparatus. The hold down apparatus is a hybrid system using both vacuum and electrostatic force to hold the media sheet flat for marking. The hold down apparatus includes a plenum vacuum transport that operates at a vacuum level to acquire and flatten the body of each sheet of substrate media. The hold down apparatus also includes an electrostatic hold down apparatus that tacks the inboard and outboard edges of the sheet to a transport belt by electrostatic pressure. The media sheet transport may be used on a printing system wherein the sheet is maintained in a flat orientation when transported through a print zone and past a marking unit wherein an image is created on the sheet. By maintaining the sheet in a flat orientation, small print head to media gaps may be achieved without inadvertent contact with the print head occurring.

The following terms shall have, for the purposes of this application, the respective meanings set forth below.

As used herein, a "printing system" refers to a device, machine, apparatus, and the like, for forming images on substrate media and a "multi-color printing system" refers to a printing system that uses more than one color (e.g., red, blue, green, black, cyan, magenta, yellow, clear, etc.) marking material to form an image on substrate media. A "printing system" can encompass any apparatus, such as a digital copier, bookmaking machine, facsimile machine, multi-function machine, etc., which performs a print outputting function. Some examples of printing systems include direct-to-paper or direct marking, ink jet, solid ink, as well as other printing systems. A "direct marking printing system" refers to a printing system that disposes a marking material directly on substrate media.

As used herein, "substrate media" or "media" refers to a tangible medium, such as paper (e.g., a sheet of paper, a long web of paper, a ream of paper, etc.), transparencies, parchment, film, fabric, plastic, or other substrates on which an image can be printed or disposed.

As used herein, an "image" refers to a visual representation, reproduction, or replica of something, such as a visual representation, reproduction, or replica of the contents of a computer file rendered visually on a belt or substrate media in a printing system. An image can include, but is not limited to: text; graphics; photographs; patterns; pictures; combinations of text, graphics, photographs, and patterns; and the like.

As used herein, "rollers" refer to shafts, rods, cams, and the like, that rotate about a center axis. Rollers can facilitate rotation of a belt about the rollers and/or can form nips through which media passes.

As used herein, a "controller" refers to a processing device or processor or for executing commands or instructions for controlling one or more components of a system and/or performing one or more processes implemented by the system.

As used herein, "tack" or "tacking" refers to holding, attracting, fixing, and the like, one object or thing to another object or thing. For example, holding, attracting, or fixing media to a surface of a transport, such as a surface of a belt or platen of the transport, by a hold down force.

As used herein, "flat" refers to lying substantially on or against something. For example, media, or a portion thereof, can lie substantially flat on a transport surface.

As used herein, a "marking unit" refers to a unit for disposing, forming, transferring, or otherwise generating an image on a belt or media, and a "direct marking unit" refers to a marking unit that disposes marking material directly on media.

As used herein, "process direction" refers to a direction in which substrate media is processed through a printing system and "cross-process direction" refers to a direction substantially perpendicular to the process direction.

As used herein, a "vacuum plenum" refers to a chamber or place in which a negative pressure is applied, and "negative pressure" referees to an air pressure that is below atmospheric pressure.

As used herein, "sensor" refers to a device that responds to a physical stimulus and transmits a resulting impulse or signal for the measurement and/or operation of controls. Such sensors include those that use pressure, light, motion, heat, sound, capacitance, magnetism, tactility, and the like. A sensor can include one or more point sensors and/or array sensors for detecting and/or measuring characteristics or parameters in a printing system, such as a distance between substrate media and a print head, a distance from a transport belt to a highest point of a media curl, and the like.

Figure 2:
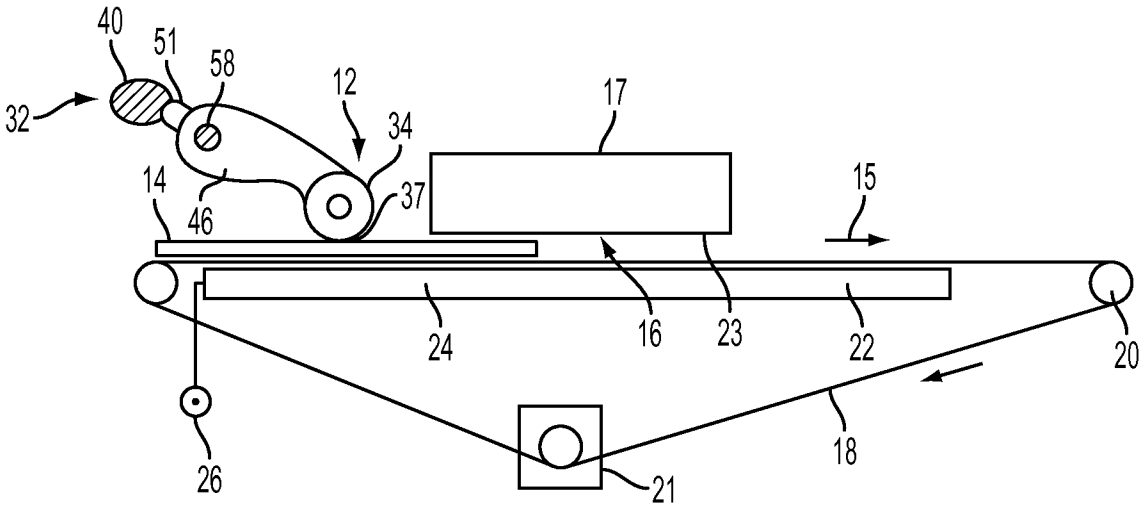
FIG. 2 is side elevational schematic view of the hold down apparatus of the present disclosure.

With reference to FIGS. 1 and 2, a printing system 5 including a printing media sheet transport 10 is shown. The sheet transport 10 includes a sheet hold down apparatus 12 for holding a sheet substantially flat. Media, such as a sheet of paper, 14 is transported in a process direction 15 through the print zone 16 and past a marking unit 17 by a continuous transport belt 18. The belt 18 may be supported by a plurality of rollers 20 and operably connected to a drive mechanism 21. When the sheet 14 is transported through the print zone 16, it is desirable to have the sheet uniformly flat in order to improve image quality and avoid sheet contact with a print head 23 portion of the marking unit. The hold down apparatus 12, therefore, includes a vacuum hold down 22 which has a vacuum plenum 24 operably connected to a vacuum source 26. The vacuum plenum 24 may be positionally fixed below the marking unit 17, and the belt 18 it driven over the plenum.

Figure 3:
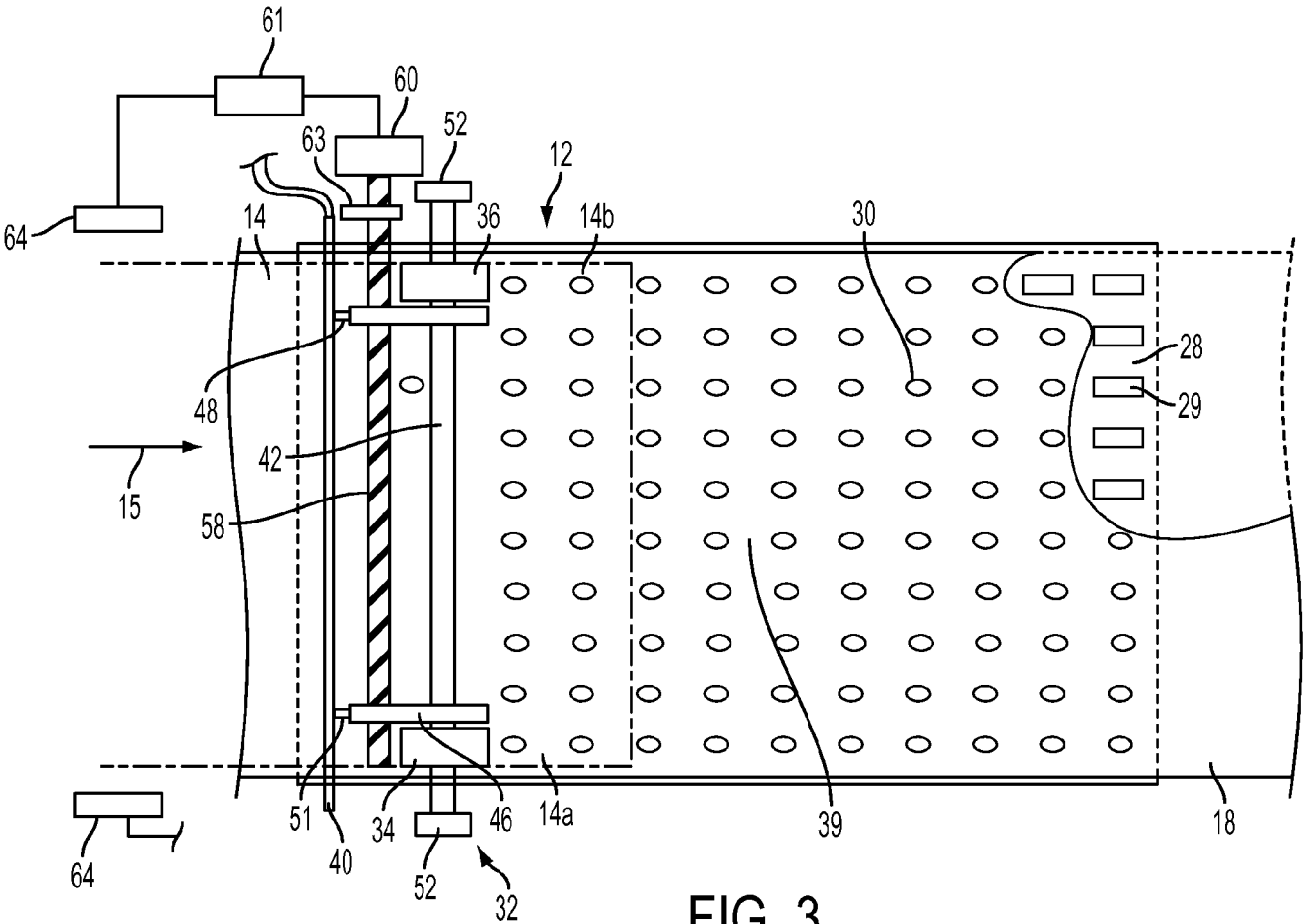
FIG. 3. is a top plan view of the hold down apparatus with a sheet of media shown in phantom and a portion of a transport belt removed to show underlying structures.

With reference to FIG. 3, the top of a vacuum plenum may include a platen 28 having a plurality of slots 29 over which the transport belt 18 translates. The transport belt 18 may include a plurality of apertures 30 formed therein such that the vacuum may flow down through the belt and platen. Accordingly, a sheet of media 14 transported over the platen 28 will be held down onto the belt 18 by the vacuum force. The vacuum in the plenum may be maintained at a relatively modest vacuum level (1-2.5 in $H_2O$) to acquire and flatten the body of each sheet.

Figure 4:
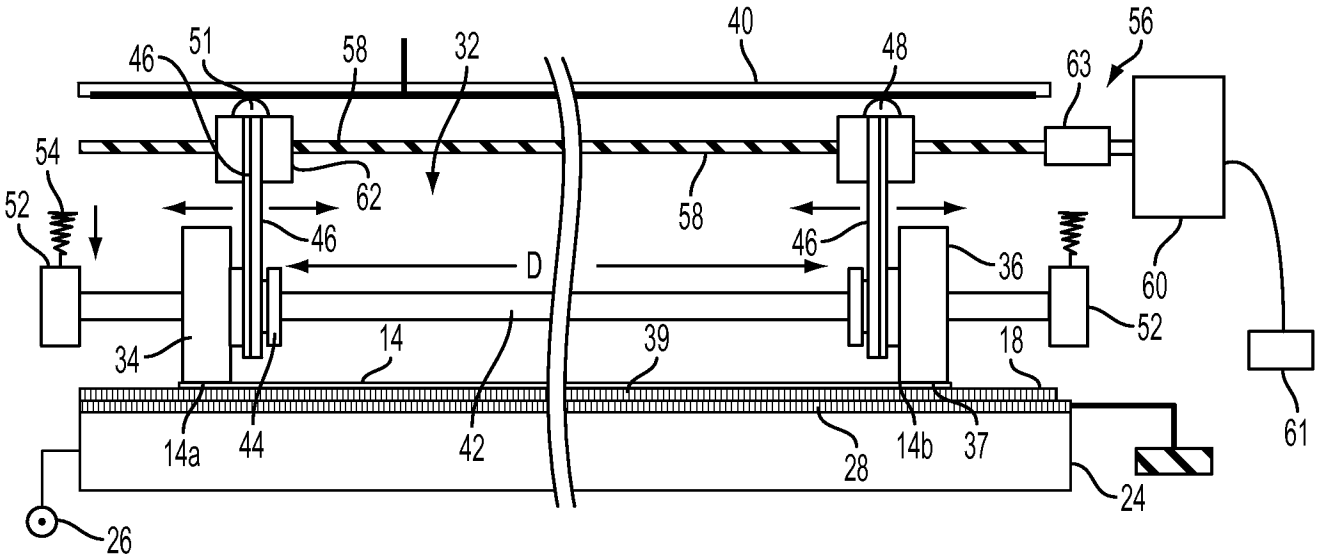
FIG. 4. is a front elevational view of a hold down apparatus.

With additional reference to FIG. 4, in addition to the vacuum hold down force acting on the sheet, an electrostatic force may be imparted to further aid in holding the sheet 14 in a flat position. This electrostatic hold down force may be applied to the inboard 14*a* and outboard 14*b* edges of the sheet. By electrostatically securing the edges of the sheet 14, a good seal is formed between the belt 18 and the sheet 14 so that less vacuum is lost past the edges of the sheet. Therefore, the vacuum hold down 22 will operate more effectively and efficiently. Additionally, the electrostatic hold down force is additive with the vacuum pressure in restraining the inboard and outboard sheet edges to remain flat. Accordingly, the entire surface of the sheet 14 may be held flat when transported through the print zone 16.

In order to create the electrostatic hold down force, an electrostatic hold down apparatus 32 may be provided. Electrostatic hold down apparatus 32 may include an inboard and an outboard tacking device 34 and 36, respectively. Tacking devices may be in the form of tacking rollers formed of a semi-conductive foam material that are relatively narrow compared to the belt 18 such that they engage only the edge portions of the sheet. Tacking devices can also consist of blade or brush structures that are placed to contact the sheet. The tacking rollers 34 and 36 are positioned with respect to the belt such that they are in rolling engagement with the belt 18 and form a pair of tacking nips 37 between belt 18 and grounded platen 28. With reference to FIGS. 2 and 3, the tacking rollers 34 and 36 may further be orientated along the process direction 15 upstream of the print zone 16. The inboard tacking roller 34 may be positioned such that it is aligned with and engages the inboard edge of the sheet 14*a*, and the outboard tacking roller 36 is aligned with and engages the outboard edge of the sheet 14*b*.

The inboard and outboard tacking rollers 34 and 36 are in operative communication with a high-voltage power source 40 wherein the tacking rollers deposit a static charge on the upper surface of the edges of the media sheet 14*a* and 14*b*. The transport belt 18 is preferably formed of a nonconductive material; and therefore, the charged surface of the sheet edges are attracted to the belt. The tacking rollers are biased to a potential sufficiently high to generate air breakdown adjacent to the nip 37 formed by the tacking rollers and the belt 18. As a sheet 14 enters the nips 37, the air breakdown will deposit net charge onto the top of the sheet along its inboard and outboard edges 14*a* and 14*b* and will thus hold the sheet edges flat to the belt 18. The medial portion of the belt 18 between the tacking rollers constitutes an image zone 39 which aligns with the print head 23. Accordingly, the portion of the sheet of media lying in the image zone 39 will receive the image. By positioning the tacking rollers 34 and 36 on the sheet edges and outside the image zone, the image zone remains substantially free of electrostatic charges.

With reference to FIGS. 3 and 4, in the present embodiment, the inboard and outboard tacking rollers 34 and 36 may each be rotatably secured to a support shaft 42 via electrically conductive hubs 44, such that the tacking rollers 34 and 36 may rotate freely about the support shaft 42. The support shaft 42 runs in the cross-process direction across the width of the belt 18. The conductive hubs 44 may each be operably coupled to a pair of electrically conductive yoke arms 46 which extends outwardly from the hubs. The yoke arms 46 extend outwardly from the hubs and terminate in a contact area 48 which is operably coupled to a high-voltage source 40 in the form of a stationary rail that extends between the two yoke arms 46. The high-voltage rail 40 may carry a positive or negative voltage. Each contact area 48 may include a conductor 51 which is operably, electrically connected to the high-voltage rail 40. The conductors 51 may each be in the form of a resilient contact which is maintained in a deflected orientation such that it is in forced contact with the high-voltage rail. Accordingly, an electrically conductive path is formed between the high voltage rail 40 and the tacking hubs 34 and 36. The conductor 51 also may slide relative to the rail 40 and remain in contact therewith. Therefore, the position of the tacking rollers 34 and 36 may be adjusted without losing electrical contact with the high-voltage rail 40. Insulators 52 are preferably located on the support shaft 42 laterally exterior of the tacking rollers such that the shaft may be supported and engaged without grounding or otherwise discharging the tacking charge.

The tacking rollers hubs 44 are biased to a sufficient voltage such that air breakdown occurs around each nip 37 thus depositing a net tacking charge onto the inboard and outboard edges of the sheet. This tacking exerts sufficient force on the sheet edges to hold them flat against the belt 18. For example, assuming a limiting Paschen breakdown field strength of 35 V/um (consistent with a 10 um paper to belt air gap), tacking pressures of up to 0.7 psi can be achieved.

With reference to FIG. 4, the support shaft 42 may be urged toward the belt surface. Biasing devices 54 may contact the insulators 52 and urge the tacking rollers 34 and 36 toward the belt 18. Accordingly, when a sheet of media 14 travels along the belt 18 and into engagement with the tacking rollers, the inboard 14*a* and outboard 14*b* edges of the sheet are urged toward the belt 18 by the force of the tacking rollers as the static charge is being imparted to the sheet. Mechanical pressure resultant from the biasing devices 54 helps to secure the inboard and outboard edges of the media sheet to the belt. After the sheet 14 exits the tacking nips 37, the sheet edges will remain flat against the belt held in place by the electrostatic charge. Since the tacking rollers 34 and 36 are in direct engagement with the surface of the media sheet, the predominant sheet charging mechanism is post-nip air breakdown causing a net charge to be deposited onto the media top surface.

With reference to FIGS. 3 and 4, sheets of media come in varying width, and in order to sheets of different widths, the electrostatic hold down apparatus 32 may include a width adjustment mechanism 56. This mechanism 56 adjusts the distance, D, between the inboard and outboard tacking rollers 34 and 36 in order to accommodate media sheet of different widths. Accordingly, the distance D between the tacking rollers is responsive to the width of the media sheet. The width adjustment mechanism 56 may include a lead screw 58 which is operably connected to a rotary actuator 60 through mechanical coupling 63. The rotary actuator 60 may be in the form of a stepper motor, dc motor, fluid driven drive or other device or devices capable of producing rotary movement.

The rotary actuator 60 is operably connected to a controller 61 which may generate a signal causing the actuator 60 to rotate the lead screw 58 in both the clockwise and counterclockwise directions. Controller 61 may include hardware such as a processor and memory and operate on software. The yoke arms 46 may be operably secured to the lead screw 58, such that upon rotation of the rotary actuator 60, the lead screw rotates thereby moving the yoke arms 46 in the cross-process direction, i.e., across the width of the belt 18. The yoke arms 46 may each include an insulating captured nut 62 that threadedly mates with the lead screw 58. The insulating captured nut 62 prevents electrical potential from being applied to the lead screw 58. The lead screw 58 is constructed with opposite pitched threads so that as the rotary actuator rotates, the yokes, and tacking rollers supported thereon, are driven in opposite directions, i.e., either toward or away from each other depending on the direction of rotation of the lead screw. Sensors (not shown) may be disposed adjacent the tacking rollers 34 and 36 and/or yoke arms 46 to determine the position of the tacking rollers. The sensors may be operably connected to the controller 61 to provide feed back and assist in controlling the position of the tacking rollers.

In operation, the width of the sheet 14 will be determined such as by a user entering or selecting a sheet width value on a user interface or by way of width sensing sensors 64 (FIG. 3) disposed along the path of the sheet upstream of the tacking rollers. The determined width information will be operably transmitted to the controller 61 which will in turn cause the rotary actuator 60 to rotate. The direction and amount of rotation is responsive to the direction and amount of repositioning the tacking rollers are to undergo. The inboard and outboard tacking rollers 34 and 36 are moved such that they are located at their respective nominal edges of the incoming media sheet 14.

Furthermore, the electrostatic charge imparted by the inboard and outboard tacking rollers 34 and 36 is applied only to the edges of the media sheet 14. Accordingly, only the sheet edges are electrostatically secured to the belt 18. The portion of the media sheet between the tacking rollers is secured to the belt 18 via the vacuum. Since only the inboard and outboard edges, i.e., top and bottom margins, are being charged there will be little, if any, electrostatic field interaction with ink jet drops within the image zone 39. This allows for high quality images to be formed using both conductive and nonconductive inks Additionally, with the edges being hold down electrostatically, the level of vacuum can be relatively low, (1-2.5 in $H_2O$), thereby reducing the amount of drag on the belt.

In order to further help maintain the sheet in a flattened position, the transport system may include a precurler device 70 as shown in FIG. 1. The precurler device 70 is disposed upstream of the sheet hold down apparatus 12. The precurler bends the sheets upstream of the sheet transport 10 to ensure that all sheets arrive either flat or downcurled, i.e., the leading and rear edges being curled downwardly toward the belt 18. This configuration allows the sheet to be more effectively held down in a flat origination by the hold down apparatus 12.

It will be appreciated that various of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the disclosed embodiments.

What is claimed is:

1. A media sheet transport comprising:

a belt for supporting the media thereon, the belt being operably connected to a drive mechanism for moving the belt in a process direction past an image marking unit, the belt having a plurality of openings therein;

a vacuum plenum having a surface disposed below the belt and being operably connected to a vacuum source, the vacuum plenum being adapted to applying a negative pressure to the media for holding the media to the belt; and an electrostatic hold down apparatus including a first tacking roller spaced in a cross-process direction from a second tacking roller, the first and second tacking rollers being engagable with the belt, the first tacking roller being disposed to engage the inboard edge of the media and the second tacking roller being disposed to engage the outboard edge of the media, the first and second tacking rollers depositing an electrostatic charge to the edges of the media for electrostatically securing the inboard and outboard edges of the media to the belt, and wherein a position of the first and second tacking rollers is adjustable in the cross-process direction and the first and second tacking rollers are operably connected to an adjustment mechanism for adjusting their position in the cross-process direction responsive to the width of the media.

2. The apparatus as defined in claim 1, wherein the first and second tacking rollers are operably coupled to an electrical power source.

3. The apparatus as defined in claim 1 , wherein the adjustment mechanism includes a lead screw operably connected to a rotary actuator, and wherein activation of the rotary actuator changes the position of the first and second tacking rollers.

4. The apparatus as defined in claim 1, wherein the first and second tacking rollers are rotatably supported on a shaft via electrically conductive hubs.

5. The apparatus as defined in claim 4, wherein the first and second tacking rollers are each secured to a yoke arm, the yoke arms extend from the inboard and outboard rollers to the lead screw.

6. The apparatus as defined in claim 5, wherein the yokes each include a resilient conductor which is in operative sliding contact with an electrical power source.

7. The apparatus as defined in claim 1, wherein the belt is formed of a non-conductive material.

8. The apparatus as defined in claim 4, wherein the shaft is biased toward the belt wherein the first and second tacking rollers urged toward the belt.

9. The apparatus as defined in claim 1, wherein the plenum surface is substantially planar and includes a plurality of apertures therein in communication with the vacuum source.

10. The apparatus as defined in claim 1, wherein a portion of the belt between the tacking rollers defines an image zone which is aligned with the marking device and the image zone is free of electrostatic charges.

11. A method for securing a sheet of media for transport past a marking device comprising:

holding the sheet down on a moving belt by applying a vacuum to the sheet;

positioning a first tacking device to substantially align with the inboard edge of the sheet;

positioning a second tacking device to substantially align with the outboard edge of the sheet;

applying an electric potential to the first and second tacking rollers;

transporting the sheet with the belt past the first and second tacking devices;

determining the width of the sheet and adjusting the position of the first and second tacking devices responsive to the sheet width; and depositing an electrostatic charge to the sheet inboard and outboard edges with the first and second tacking devices to electrostatically secure the sheet inboard and outboard edges to the belt.

12. The method as defined in claim 11, further including actuating a rotary actuator to position the first and second tacking devices.

13. A media sheet transport comprising:

a belt for supporting the media thereon, the belt being operably connected to a drive mechanism for moving the belt in a process direction past an image marking unit, the belt having a plurality of openings therein;

a vacuum plenum having a surface disposed below the belt and being operably connected to a vacuum source, the vacuum plenum being adapted to applying a negative pressure to the media for holding the media to the belt; and an electrostatic hold down apparatus including a first tacking roller spaced in a cross-process direction from a second tacking roller, the first and second tacking rollers being engagable with the belt, the first tacking roller being disposed to engage the inboard edge of the media and the second tacking roller being disposed to engage the outboard edge of the media, the first and second tacking rollers depositing an electrostatic charge to the edges of the media for electrostatically securing the inboard and outboard edges of the media to the belt, and wherein the first and second tacking rollers are rotatably supported on a shaft via electrically conductive hubs.

14. The apparatus as defined in claim 13, wherein the first and second tacking rollers are each secured to a yoke arm, the yoke arms extend from the inboard and outboard rollers to the lead screw.

15. The apparatus as defined in claim 14, wherein the yokes each include a resilient conductor which is in operative sliding contact with an electrical power source.

* * * * *